US012066280B2

(12) United States Patent
Harlan

(10) Patent No.: US 12,066,280 B2
(45) Date of Patent: Aug. 20, 2024

(54) DART AND DART GAME

(71) Applicant: Clifford Harlan, New Orleans, LA (US)

(72) Inventor: Clifford Harlan, New Orleans, LA (US)

( * ) Notice: Subject to any disclaimer, the term of this patent is extended or adjusted under 35 U.S.C. 154(b) by 79 days.

(21) Appl. No.: 18/048,956

(22) Filed: Oct. 24, 2022

(65) Prior Publication Data

US 2023/0128172 A1 Apr. 27, 2023

Related U.S. Application Data

(60) Provisional application No. 63/263,034, filed on Oct. 26, 2021.

(51) Int. Cl.

| | |
|---|---|
| ***A63B 65/02*** | (2006.01) |
| ***F42B 6/00*** | (2006.01) |
| *F41J 3/00* | (2006.01) |

(52) U.S. Cl.

CPC ..... *F42B 6/003* (2013.01); *F41J 3/0009* (2013.01)

(58) Field of Classification Search

CPC ..... F41J 1/00; F41J 3/00; F41J 3/009; F41J 3/0009; F42B 6/003; F42B 6/04; F42B 6/06

See application file for complete search history.

(56) References Cited

U.S. PATENT DOCUMENTS

| | | | | |
|---|---|---|---|---|
| 3,059,928 | A * | 10/1962 | Flanagan | F41J 3/0066 273/408 |
| 4,583,745 | A | 4/1986 | Ladner | |
| 4,886,280 | A | 12/1989 | Bottelsen | |
| 5,118,117 | A | 6/1992 | Denen | |
| 5,207,434 | A | 5/1993 | Oudekerk | |
| 5,324,044 | A | 6/1994 | Giegerich | |
| 5,642,887 | A | 7/1997 | Orav | |
| 5,967,915 | A | 10/1999 | Lu et al. | |
| 6,248,033 | B1 | 6/2001 | Lowy | |

(Continued)

FOREIGN PATENT DOCUMENTS

| | | |
|---|---|---|
| GB | 2477298 | 3/2011 |
| GB | 2531362 | 2/2014 |
| JP | 2012239635 A | 5/2012 |

OTHER PUBLICATIONS

Intelite Products—One 80 Dart—www.one80dart.com, accessed Feb. 24, 2021, 3 pages.

*Primary Examiner* — John A Ricci

(74) *Attorney, Agent, or Firm* — Garvey, Smith & Nehrbass, Patent Attorneys, L.L.C.; Fabian M. Nehrbass; Julie R. Chauvin

(57) ABSTRACT

A recreational throwing dart comprising a target area at the rear capable of capturing the tip of another dart thrown into it while the dart is in the dartboard and a game comprising said dart. The dart is thrown into the dartboard and then a second dart is thrown at the target area of the first dart in the dartboard. The point of the second dart can stick into, be mechanically captured by, or otherwise adhere to the rear portion of the first dart. This dart creates a new form of gameplay different from traditional dart rules in which the tip of all darts must strike and stick into the dartboard itself. The invention allows the darts to not be damaged by the second dart sticking into the rear of it as happens when a standard dart pierces a dart flight or a dart shaft.

20 Claims, 12 Drawing Sheets

(56) References Cited

U.S. PATENT DOCUMENTS

| | | | |
|---|---|---|---|
| 6,277,041 | B1 | 8/2001 | Fenn |
| 6,524,201 | B2 | 2/2003 | Fenn |
| 6,974,398 | B2 | 12/2005 | Murphy |
| 7,108,620 | B1 | 9/2006 | Yiu |
| 7,241,236 | B1 | 7/2007 | Chen |
| 7,871,344 | B1 | 1/2011 | Massman |
| 8,177,668 | B2 | 5/2012 | Matsubara |
| 9,435,620 | B2 | 9/2016 | Hamazaki et al. |
| 10,591,261 | B1 | 3/2020 | Gustafson |

* cited by examiner

FIG. 20
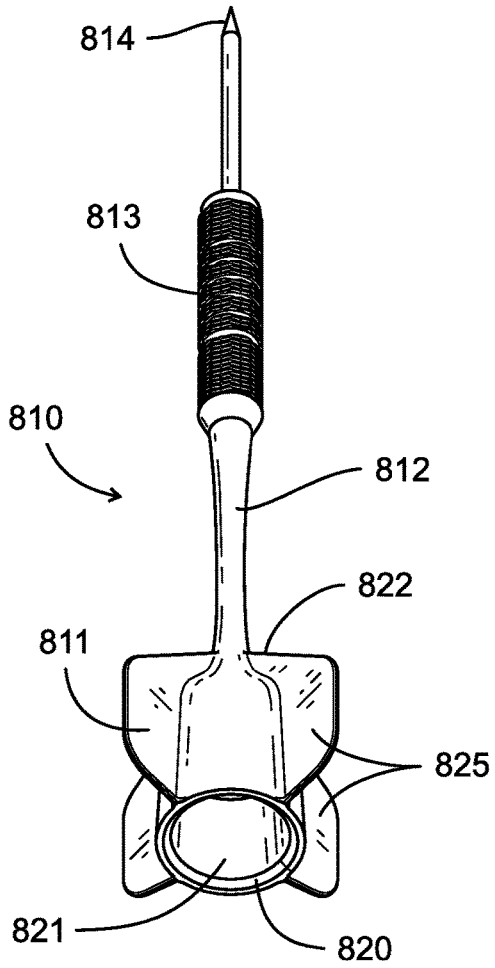
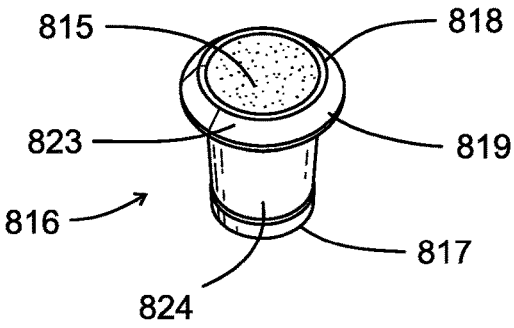
FIG. 21
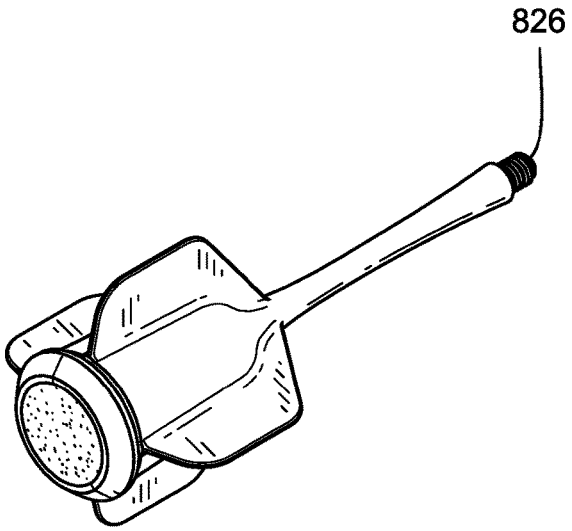
FIG. 22

FIG. 23
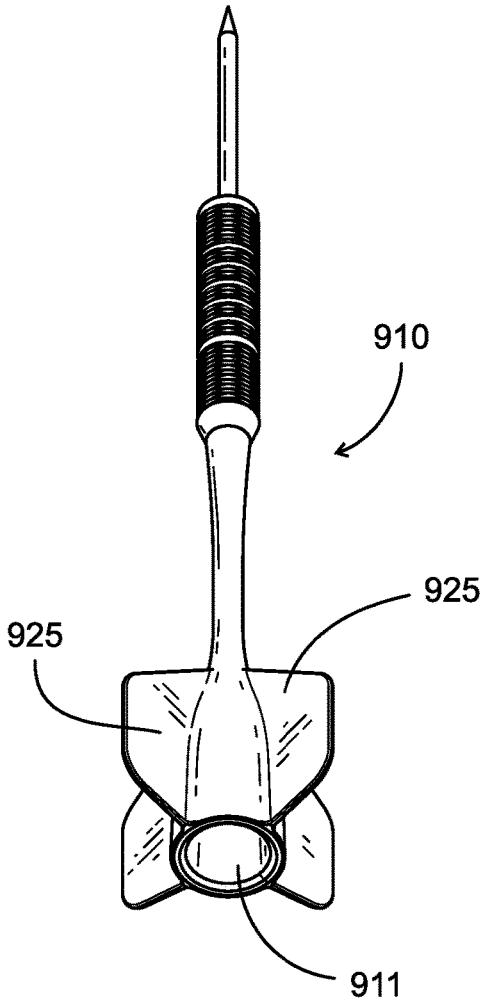
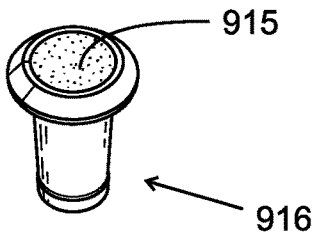
FIG. 24
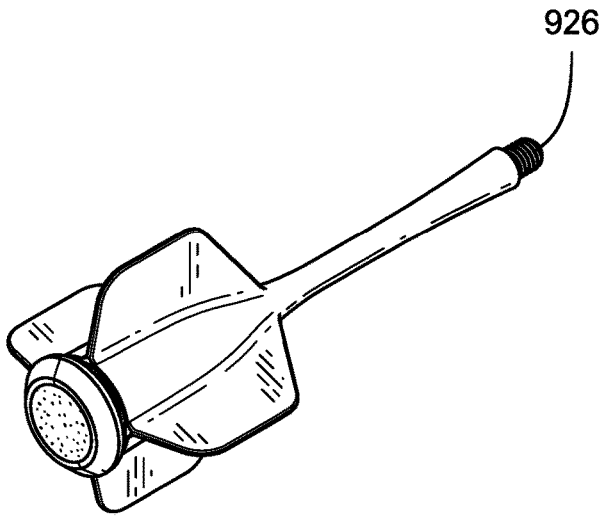
FIG. 25

DART AND DART GAME

CROSS-REFERENCE TO RELATED APPLICATIONS

This application claims priority to my U.S. Provisional Patent Application No. 63/263,034, filed 26 Oct. 2021, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to darts, modifications to traditional darts, and modifications to the traditional game of darts. More particularly, the present invention relates to a dart, flight unit, dart attachment, or flight attachment capable of receiving the tip/point of another dart thrown into the dart while the dart is in the dartboard, without damaging either dart. This novel dart allows for modification of traditional dart game play which requires the tip of all darts to strike and stick to the dartboard itself to score. Also included are methods of game play utilizing the novel dart, flight unit, dart attachment, or flight attachment capable of receiving the tip of another dart.

2. General Background of the Invention

In standard dart rules, only darts that stick into the dartboard can count towards scoring. More specifically, a dart must remain in the target (dartboard) for the duration of a player's turn in order to count towards scoring. When a dart strikes a previously thrown dart, the subsequently thrown dart can bounce out or get stuck in the previously thrown dart (thus not adhering to the dartboard) or at best, simply be redirected (thus not striking the intended area). Darts which strike a divider in the dartboard have a lower chance of remaining in the dartboard as required for scoring. As such, there have been several dart modifications to reduce the chance of a dart not striking and adhering to the dartboard or to limit the chance a dart is directed away from its intended target area. Dart modifications have focused on: (1) limiting the chance a subsequently thrown dart strikes the rear of a previously thrown dart; (2) minimizing any deflection by a subsequently thrown dart occurring when striking the rear of a previously thrown dart; and (3) preventing bouncing off the dartboard after striking a divider in the dartboard. In seeking to limit the chances that a subsequently thrown dart adheres to a previously thrown dart, there have been designs to limit the chances that a "Robinhood" occurs. In traditional darts, a "Robinhood" occurs when a dart is thrown into a dartboard and a subsequently thrown dart lands in the rear portion of the previously thrown dart and sticks to the previously thrown dart. Typically, the tip of the subsequently thrown dart is stuck in the shaft or flight of the previously thrown dart. Because a Robinhood does not result in scoring for the subsequently thrown dart in traditional darts and because a dart striking a previously thrown dart can cause damage to the rear portion of the previously thrown dart (whether or not a Robinhood occurs), prior dart modifications have sought to reduce the chances of subsequently thrown darts striking previously thrown darts as well as the occurrence of Robinhoods. For example, in U.S. Pat. No. 4,886,280 entitled "Dart with Flight Lock", Bottelsen discloses a dart comprising a flight holder with a pointed rearward end which "obviates the need for a deflector at the back of the flight by eliminating or at least severely reducing the occurrence of 'Robinhoods.'" Similarly, in U.S. Pat. No. 4,583,745 entitled "Dart Flight", a gradually tapered dart flight is disclosed to minimize damage to a first thrown dart and to minimize the redirection of subsequently thrown darts which strike a first dart.

Rather than adopt the approach of the prior art in seeking to avoid the striking of one dart with another or the occurrence of Robinhoods, the present invention provides novel dart embodiments which not only prevent damage to the darts when a subsequently thrown dart strikes the rear of a previously thrown dart, but also allow for (and can encourage) adherence of the second dart to the first by providing a modified rear portion designed to capture the tip of a subsequently thrown dart, without damaging the first thrown dart. Also included in the present invention are methods of modified gameplay which incorporate the novel dart embodiments.

The following patent documents are incorporated herein by reference:

| Document No. | Title | Issue Date |
|---|---|---|
| U.S. Pat. No. 4,583,745 | Dart flight | 1986 Apr. 22 |
| U.S. Pat. No. 4,886,280 | Dart with Flight Lock | 1989 Dec. 12 |
| U.S. Pat. No. 5,118,117 | Recreational dart | 1992 Jun. 2 |
| U.S. Pat. No. 5,207,434 | Throwing Dart with Collapsible Tail Portion | 1993 May 4 |
| U.S. Pat. No. 5,324,044 | Dart Assembly | 1994 Jun. 28 |
| U.S. Pat. No. 5,642,887 | Game Dart with Retractable Flight Section | 1997 Jun. 01 |
| U.S. Pat. No. 5,967,915 | Dart | 1999 Oct. 19 |
| U.S. Pat. No. 6,248,033 | Darts for the Game of Darts | 2001 Jun. 19 |
| U.S. Pat. No. 6,277,041 | Dart Having Resiliently Mounted Point and Flight Shaft, and User-modifiable Body and Weighting Features | 2001 Aug. 21 |
| U.S. Pat. No. 6,524,201 | Darts: User Applied Modifiable Body and Mechanisms | 2003 Feb. 25 |
| U.S. Pat. No. 6,974,398 | Magnum Bullet Darts | 2005 Dec. 13 |
| U.S. Pat. No. 7,108,620 | Game Dart Having Ballast | 2006 Sep. 19 |
| U.S. Pat. No. 7,241,236 | Dart with dual action arrangement | 2007 Jul. 10 |
| U.S. Pat. No. 7,871,344 | Dart | 2011 Jan. 18 |
| U.S. Pat. No. 8,177,668 | Dart | 2012 May 15 |
| U.S. Pat. No. 9,435,620 | Flight Unit and Dart | 2016 Sep. 6 |
| U.S. Pat. No. 10,591,261 | Sliding shaft for throwing dart | 2020 Mar. 17 |
| GB 2477298 A | Tri-flights and stems | 2011 Mar. 08 |
| GB 2531362 A | Improvements to dart flights | 2016 Apr. 20 |
| JP 2012-239635 A | Dart and dart flight | 2012 Dec. 10 |

BRIEF SUMMARY OF THE INVENTION

Generally, a dart consists of a sharp point or tip that makes contact with the target, a barrel or grip, a shaft, and a flight, or if it has a connected shaft and flight then a flight unit. The apparatus of the present invention preferably comprises a modified shaft, flight, flight attachment, or flight unit which provides an area that allows a subsequently thrown dart to stick to and adhere to a previously thrown dart. In various embodiments, the apparatus of the present invention may include the entire dart or simply a modified portion which can adhere to/attach to or engage with a standard game dart or a portion of same. The present invention further comprises modified gameplay wherein "Robinhoods" are scored.

In one or more embodiments, a dart is provided which comprises two opposing ends, the two opposing ends comprising a front end and a rear end, with a device at the rear end that is capable of capturing and securing the tip of another dart.

In one or more embodiments, a dart comprises an area at a rear end of the dart used as a target for a subsequent dart to be thrown into.

In one or more embodiments, a dart flight comprises a central feature that is generally conical or cylindrical in shape, wherein said central feature is filled with foam or a similar material that can capture and secure a dart tip.

In one or more embodiments, a dart flight or dart shaft and flight unit that is shaped to capture the tip of another dart.

In one or more embodiments, the present invention comprises a dart flight, dart shaft, or dart that can capture the tip of another dart without sustaining damage.

In one or more embodiments, a dart comprises a tip, shaft and flight, and a rear end which comprises an area for receiving another dart, wherein the area receives a tip of the other dart.

In one or more embodiments, a dart flight unit and shaft comprise a flight, a threaded end, a shaft, a shaft rear end and a target area, wherein the target area is located in the shaft rear end and is sized and shaped to receive the tip of another dart and wherein the threaded end can thread onto a barrel or grip portion of a dart.

In one or more embodiments, a dart flight comprises multiple fins, a front portion which can attach to a dart shaft and a rear portion which is sized and shaped for receiving the tip of another dart.

In one or more embodiments, at least two of the fins are foldable.

In one or more embodiments of the present invention, the target area is cylindrical.

In one or more embodiments of the present invention, the target area is square. In certain methods of gameplay, darts can be utilized which include different shaped target areas. For example, one dart may have a cylinder-shaped target area and another may have a square shaped target area.

In one or more embodiments, the target area can be filled with one or more channels or holes for receiving one or more darts. For example, the channels or holes can be shaped so as to receive the tip or point of a subsequently thrown dart.

In one or more embodiments, a dart flight unit comprises multiple fins, a front portion which can attach to a dart shaft and a rear portion which houses or includes a target area for receiving the tip of another dart. In certain embodiments, the rear portion is integrated into the dart flight.

In one or more embodiments, a dart flight unit comprises multiple fins, a front portion which can attach to a dart shaft and a rear portion which is sized and shaped so as to receive a barrel and/or point of another dart.

In one or more embodiments, an attachment to a dart flight comprises a body which houses a target area, and a front portion which attaches to the dart flight of a dart.

In one or more embodiments, a dart game utilizes the dart or the dart attachments as disclosed herein.

In one or more embodiments, a method of gameplay uses a dart, dart attachment, or dart flight as described herein to allow for modifying the rules as set forth herein.

In one or more embodiments, a dart comprises a point, a barrel, a shaft, and a flight, wherein the flight comprises a target area. The target area can be sized and shaped for receiving another dart. Specifically, the target area can be sized and shaped for receiving the tip or point of another dart. Preferably, the target area is able to capture the tip or point of another dart so that the subsequently thrown dart adheres to/is stuck in the rear of the dart (so that a "robinhood" has taken place).

In the various embodiments described herein, the dart flight can comprise different numbers of fins. For example, in one or more embodiments, the flight comprises four fins. In one or more embodiments, the flight comprises three fins. The target area can be located centrally between the fins of the flight. For example, the fins can extend radially away from a central target.

In one or more embodiments, the flight includes a central cavity, said cavity having an exterior and interior, the fins connected to and extending radially away from the exterior of said central cavity and the interior of the cavity housing the target area. The fins can be equally spaced from each other, such that if there are four fins, each fin is spaced 90 degrees from each other, while if there are three fins, each fin would be spaced 120 degrees from each other, and so on.

The target area or capture area of various embodiments of the present invention is preferably made of a material suitable for receiving and capturing the tip or point of another dart. For example, the target area or capture area may be made of cork, sisal, or foam.

In certain embodiments, the target area is removable and replaceable.

In one or more embodiments, a dart flight unit apparatus comprises a flight unit having a proximal end and a distal end, wherein the proximal end is connectable to a dart shaft and a target area is located at the distal end of the flight unit, said target area sized and shaped to receive a point of another dart.

In one or more embodiments, the dart flight unit comprises a central, longitudinally extending bore and multiple flight fins, said fins extending radially away from the central, longitudinally extending bore.

In one or more embodiments, the target area is part of a larger target insert, said target insert being sized and shaped to fit within the central, longitudinally extending bore of the flight unit.

In one or more embodiments, the target insert has a proximal end and a distal end, said distal end having a lip portion which is sized and shaped to extend radially past an inner diameter of the central, longitudinally extending bore.

In one or more embodiments, the flight unit and shaft comprise a unitary structure. Thus, although the novel flight can be attached to an existing dart, in other embodiments the novel flight can be part of a unitary structure (and thus the flight would not be removable in such a case).

Various methods of game play are presented and described herein using the novel dart/dart flight/flight attachments.

In one or more methods of game play, the game is played with multiple throwing darts and dart board, wherein (a) at least one of the darts in play is a flight target dart, said flight target dart comprising a point, a shaft, and a flight, wherein the flight comprises a target area, said target area being sized and shaped for receiving another dart, wherein the target area can receive a tip of the other dart; and (b) game play is modified such that scoring occurs when a dart strikes and is adhered to the target area of one of the at least one flight target darts, when the flight target dart has struck and adhered to a scoring area of the dart board.

In one or more methods of gameplay, a player who throws a dart into the target area of a previously thrown dart scores the numerical value of the previously thrown dart.

In one or more methods of gameplay, a player who throws a dart into the target area of a previously thrown dart scores twice the numerical value of the previously thrown dart.

In one or more methods of gameplay, a player who throws a dart into the target area of a previously thrown dart by another player scores the numerical value of the previously thrown dart and the player who threw the initial dart loses the same numerical value.

In one or more methods of gameplay, a player who throws a dart into the target area of a previously thrown dart by another player causes the other player to lose said previously thrown dart for the rest of the game. In certain methods of gameplay, the dart could be scored as well.

In one or more methods of gameplay, each player has three flight target darts during game play.

In one or more methods of gameplay, players alternate throws of their flight target darts during game play.

In one or more embodiments, a dart comprises a point, a shaft, a barrel, and a flight, wherein the flight comprises a rear target area, said target area being sized and shaped for capturing the point of another dart. In one or more embodiments, the shaft has a proximal portion and distal portion, the proximal portion of the shaft terminating at the barrel and the distal portion of the shaft being integrated with the flight, wherein the distal portion of the shaft comprises a cavity which houses the target area. In one or more embodiments, the target area protrudes distally of the distal end of the shaft. In one or more embodiments, the target area is flush with the distal end of the shaft. In one or more embodiments, the target area is recessed within the distal end of the shaft. In one or more embodiments, the flight comprises four fins. In one or more embodiments, the flight comprises three fins. The target area can be comprised of one or more of the following materials: foam, rubber, sisal, or cork. The flight can comprise a plurality of fins and the rear target area can be located centrally of the plurality of fins. The rear target area, as seen from a rear view of the dart, can be circular. In other embodiments, the rear target area, as seen from a rear view of the dart, can square.

In one or more embodiments, the fins of the flight are foldable.

In one or more embodiments, the rear target area comprises a plurality of smaller targets.

In one or more embodiments, the rear target area is housed in a removable target insert.

In one or more embodiments, a dart comprises a point, a shaft, and a flight, wherein the flight includes a means for receiving the tip of another dart. The means for receiving can comprise a plug made of cork, sisal, foam, or rubber, or a combination thereof.

In one or more embodiments, a dart comprises a point section, a barrel section, a shaft section, and a flight section, wherein the flight section includes a means for receiving the tip section of another dart. The means for receiving can comprise a plug made of cork, sisal, foam, or rubber, or a combination thereof.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 20 is a perspective view of a ninth embodiment of the apparatus of the present invention wherein the rear target has been removed;

FIG. 21 is a perspective view of a rear target to be used with a ninth embodiment of the apparatus of the present invention;

FIG. 22 is a perspective view of a portion of a ninth embodiment of the apparatus of the present invention;

FIG. 23 is a perspective view of a tenth embodiment of the apparatus of the present invention wherein the rear target has been removed;

FIG. 24 is a perspective view of a rear target to be used with a tenth embodiment of the apparatus of the present invention;

FIG. 25 is a perspective view of a portion of a tenth embodiment of the apparatus of the present invention;

DETAILED DESCRIPTION OF THE INVENTION

Figure 1:
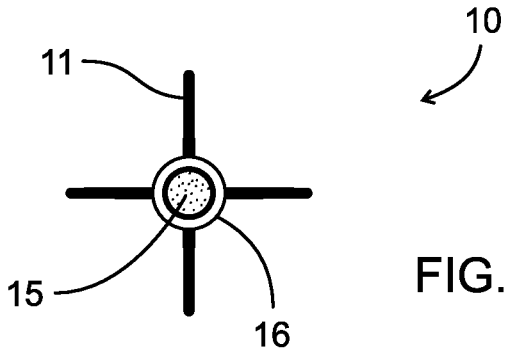
FIG. 1 is a rear view of a first embodiment of the apparatus of the present invention.
Figure 2:
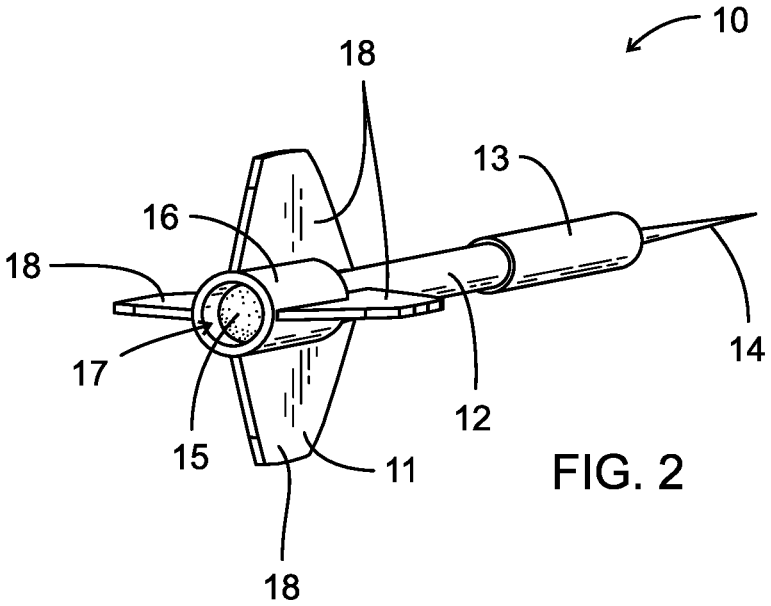
FIG. 2 is a rear perspective view of a first embodiment of the apparatus of the present invention.
Figure 3:
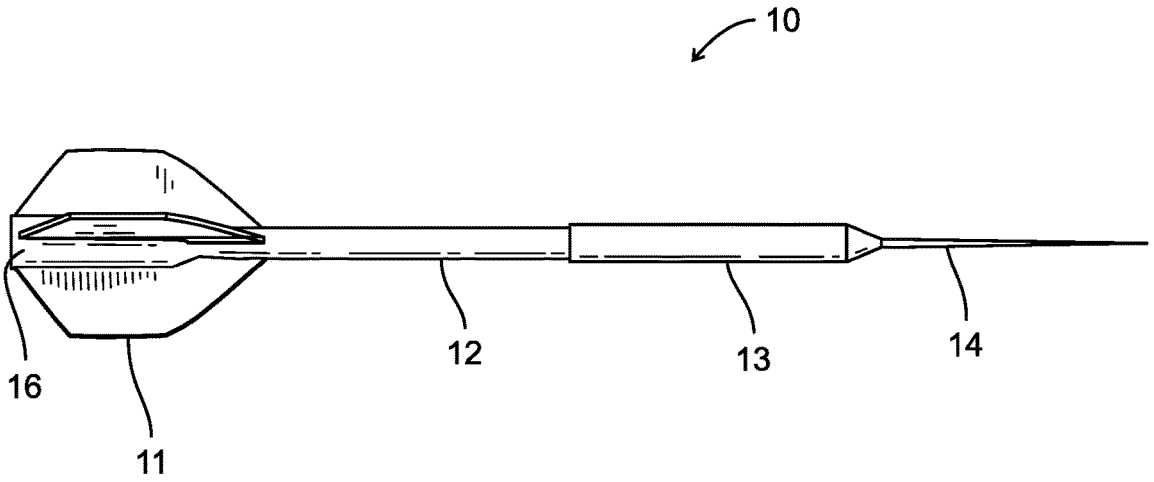
FIG. 3 is a side perspective view of a first embodiment of the apparatus of the present invention.
Figure 4:
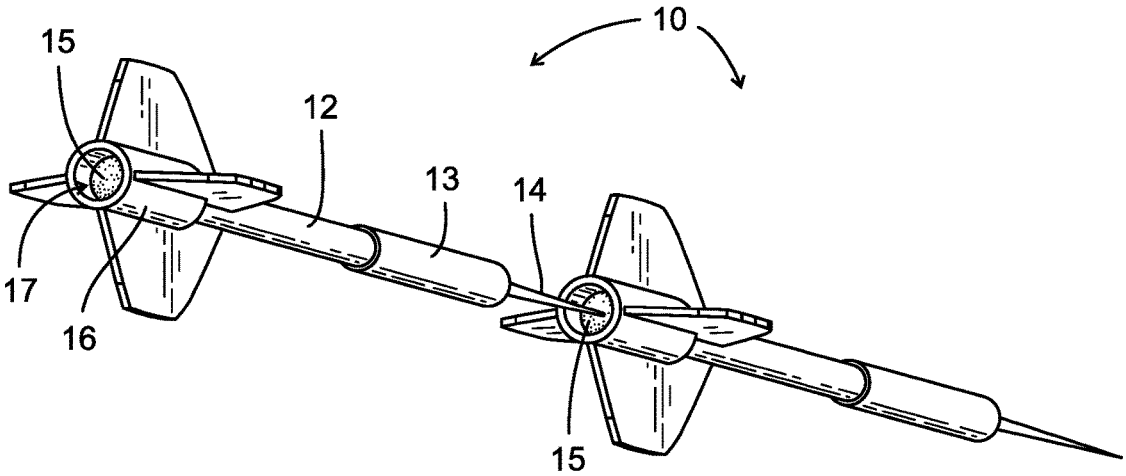
FIG. 4 is a perspective view showing two darts of a first embodiment of the apparatus of the present invention wherein one dart is stuck into the rear end portion of another dart.

FIGS. 1-4 are various views showing a first embodiment of the apparatus of the present invention designated generally by the numeral 10. Dart or gamepiece 10 preferably comprises a flight 11, a shaft 12, a barrel or grip 13, a tip or point 14, and a target/target area/receiving area 15. The target/receiving area 15 is preferably located within a cavity/recessed portion 17 of the rear end or area 16 of shaft 12 (when the shaft 12 and flight section 11 are part of a single structure as shown). Alternatively, target/receiving area 15 can be in a cavity located centrally of the flight fins 18 in other embodiments in which the flight is separate from the shaft 12. Although target 15 is shown recessed in the cavity 17 of the rear end 16 of shaft 12, the target need not be recessed. The target can be flush with the outermost portion of the cavity 17, the target can extend past the outermost portion of cavity 17, or the target can be partially recessed (as shown in FIGS. 2 and 4, for example). FIG. 1 is a rear view of dart 10, showing the target 15 in the center area of the rear end 16 of shaft 12. Target 15 allows another dart 10 to stick to/adhere to/be captured by an initial dart by receiving the other dart's tip or point 14. Target 15 in the rear of the dart 10 thus enables another dart 10 to stick into the rear of the dart 10.

FIG. 4 is a perspective view showing one dart 10 of the first embodiment striking another dart 10 of the first embodiment in the target area 15 by the dart's point or tip 14. As can be seen in FIG. 4, a dart 10 that strikes another dart 10 in its target area 15 can cause the two darts 10 to be stuck together. Furthermore, the target area 15 of the second dart 10 is available for another dart, for example, a third dart, to strike same, adhering three darts together.

Figure 5:
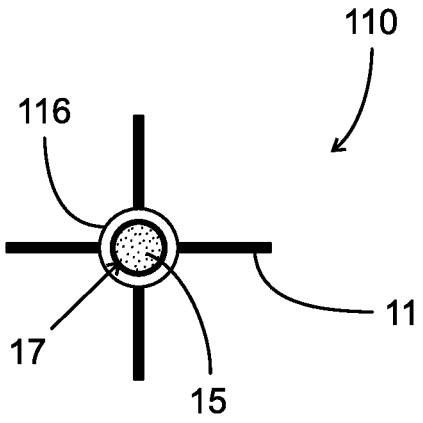
FIG. 5 is a rear view of a second embodiment of the apparatus of the present invention.
Figure 6:
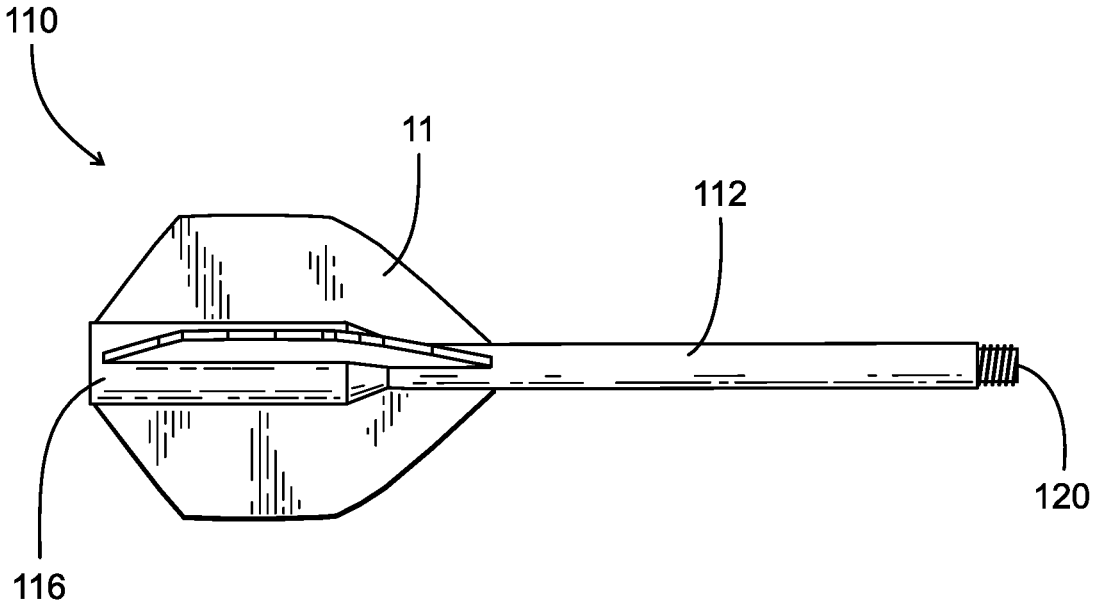
FIG. 6 is a side view of a second embodiment of the apparatus of the present invention.

FIGS. 5-6 show a second embodiment of the present invention designated generally by numeral 110. Flight unit with threaded shaft 110 preferably comprises flight 11, shaft 112, shaft rear end 116, cavity 17, target 15, and threaded end 120. The second embodiment is similar to the first embodiment shown in FIGS. 1-4. Flight unit with threaded shaft 110 lacks the barrel or grip 13 of dart 10 as well as the point or tip 14 of dart 10. Flight unit with threaded shaft 110 has a threaded end 120 of shaft 112 which allows it to attach, for example by screwing onto, a barrel and tip attachment. Thus, flight unit with threaded shaft 110 can be attached to existing dart parts to create a dart similar to the dart of the first embodiment.

Figure 7:
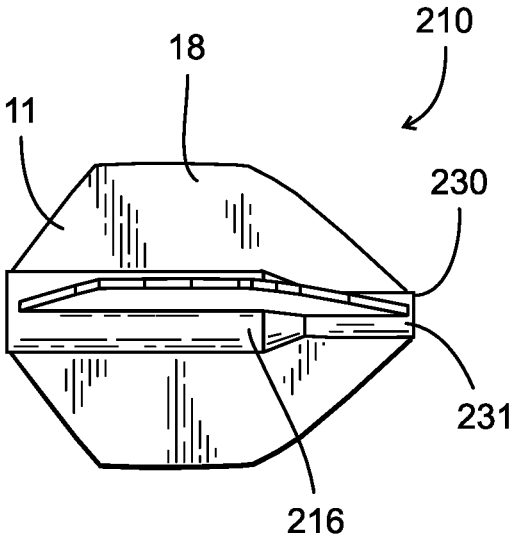
FIG. 7 is a side view of a third embodiment of the apparatus of the present invention.
Figure 8:
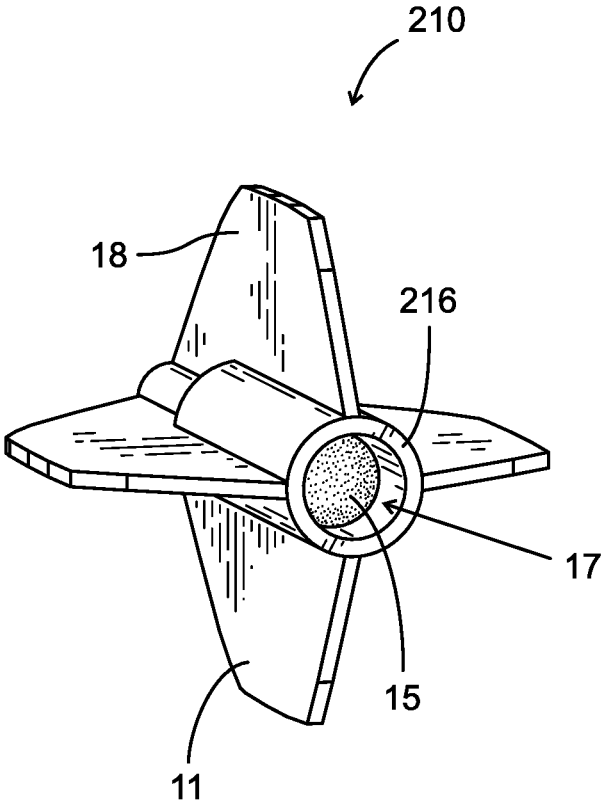
FIG. 8 is a rear perspective view of a third embodiment of the apparatus of the present invention.
Figure 9:
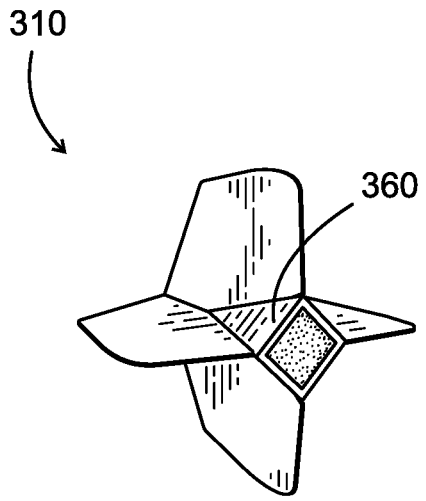
FIG. 9 is a rear perspective view of a fourth embodiment of the apparatus of the present invention.
Figure 10:
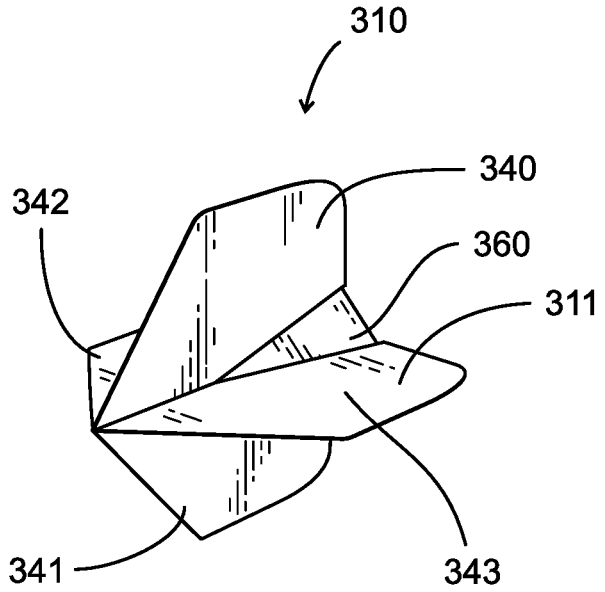
FIG. 10 is a front perspective view of a fourth embodiment of the apparatus of the present invention.
Figure 11:
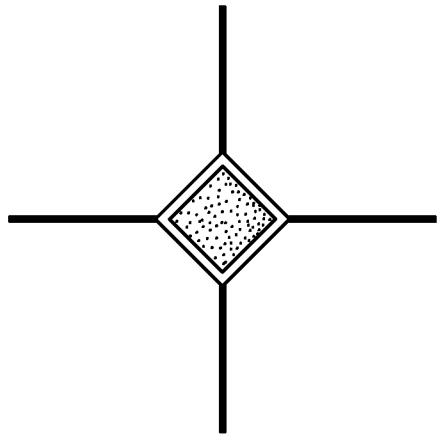
FIG. 11 is a rear view of a fourth embodiment of the apparatus of the present invention.
Figure 12:
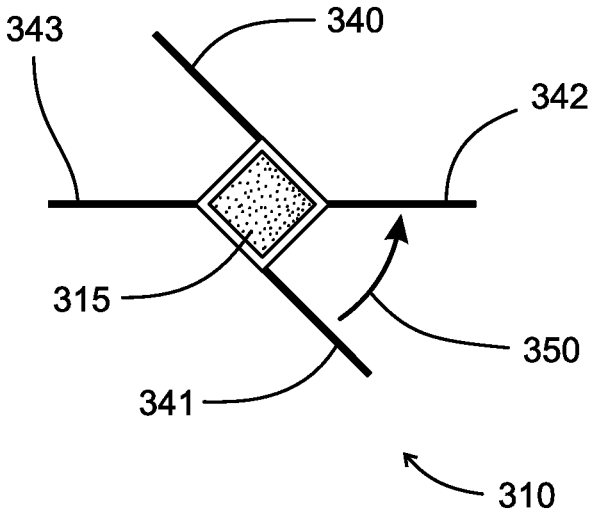
FIG. 12 is a rear view of a fourth embodiment of the apparatus of the present invention.

FIGS. 7-8 show a third embodiment of the apparatus of the present invention designated generally by numeral 210. Flight unit/flight attachment 210 preferably comprises flight 11, rear shaft portion 216, cavity 17, target 15, and shaft attachment 230. Shaft attachment 230 of flight unit 210 is preferably sized and shaped to allow attachment of flight unit 210 to a shaft of a dart so as to modify a normal dart into one with a rear target area as set forth in the present invention. In other embodiments, the flight attachment 230 is sized the same as a standard flight (the fins 18 connect at a central axis and there is no body, similar to the embodiment shown in FIGS. 9-12, for example; there is no body, such as cylindrical body 231 that is centrally located of the forward end of the fins).

FIGS. 9-12 show a fourth embodiment of the present invention designated generally by the numeral 310. Flight unit/flight attachment 310 is similar to flight unit 210. However, flight unit 310 comprises two or more folding fins 340, 341 of flight 311 and two or fewer non-folding fins 342, 343. That is, dart attachment 310 could have two, three, or four folding fins and two, one, or zero non-folding fins, respectively. In the drawings shown, only two folding fins, 340, 341, are shown. The folding fins 340, 341 allow for easier storage and shipment of flight unit 310. As shown by arrow 350, fin 341 can move toward fin 342 for storage (while fin 340 can move toward fin 343). Flight unit 310 also preferably comprises a target 315 which can be generally square in shape and not recessed like the target shown in FIGS. 1-8. Target 315 is preferably located within flight unit rear portion 360, which may be shaped as a square pyramid as depicted in FIGS. 9-12. The target in each of the various embodiments can take the form of various shapes and materials and can, but need not be, recessed in each of the various embodiments. The other embodiments described herein and shown in the figures can, but need not have, folding fins as well. In each of the other embodiments, each flight preferably comprises multiple fins, as depicted in the figures. The flights are also not limited to four fins as is shown in the figures.

Figure 13:
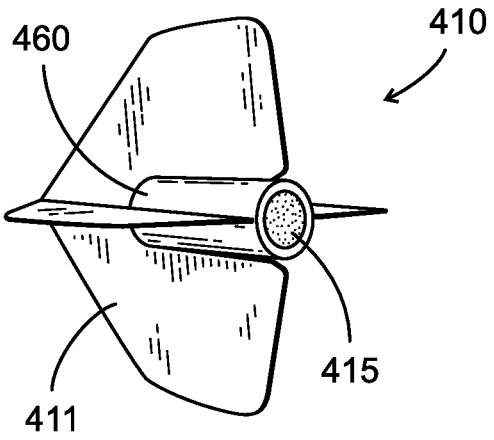
FIG. 13 is a rear perspective view of a fifth embodiment of the apparatus of the present invention.
Figure 14:
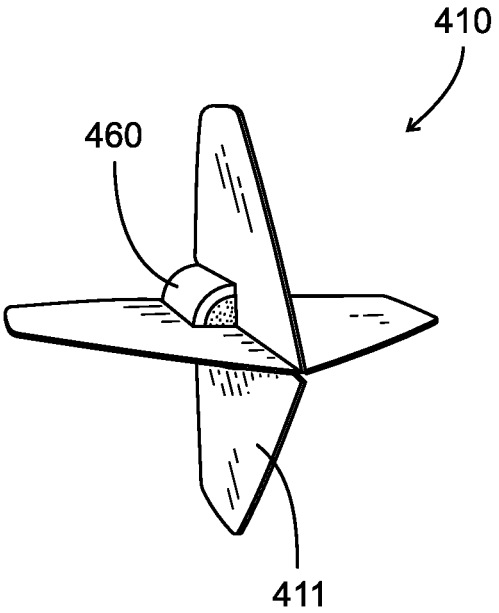
FIG. 14 is a front perspective view of a fifth embodiment of the apparatus of the present invention.
Figure 15:
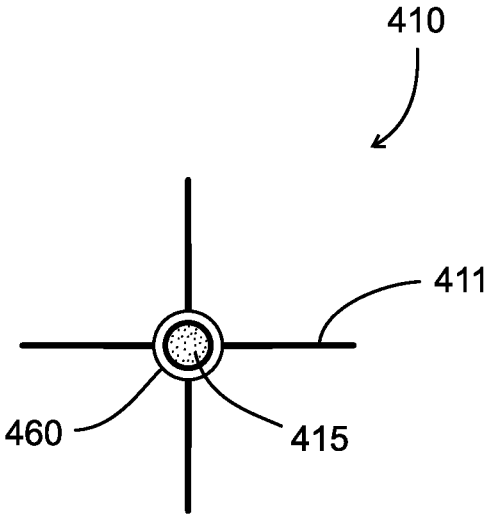
FIG. 15 is a rear view of a fifth embodiment of the apparatus of the present invention.

FIGS. 13-15 show a fifth embodiment of the apparatus of the present invention designated generally by the numeral 410. Flight unit/dart attachment 410 preferably comprises flight unit 411, a flight unit rear portion 460 that is generally cylindrically shaped and corresponding target area 415. In this fifth embodiment, similar to the fourth embodiment 310, flight unit rear portion 460 which preferably houses the corresponding target 415 is preferably integrated into the flight component 411 rather than a part of the shaft of the overall dart (not pictured). In this way, flight units 310 and 410 can be directly attached to a dart of the prior art, converting said dart into a dart capable of receiving the point or tip of a dart and allowing for modified game play, as described herein.

Figure 16:
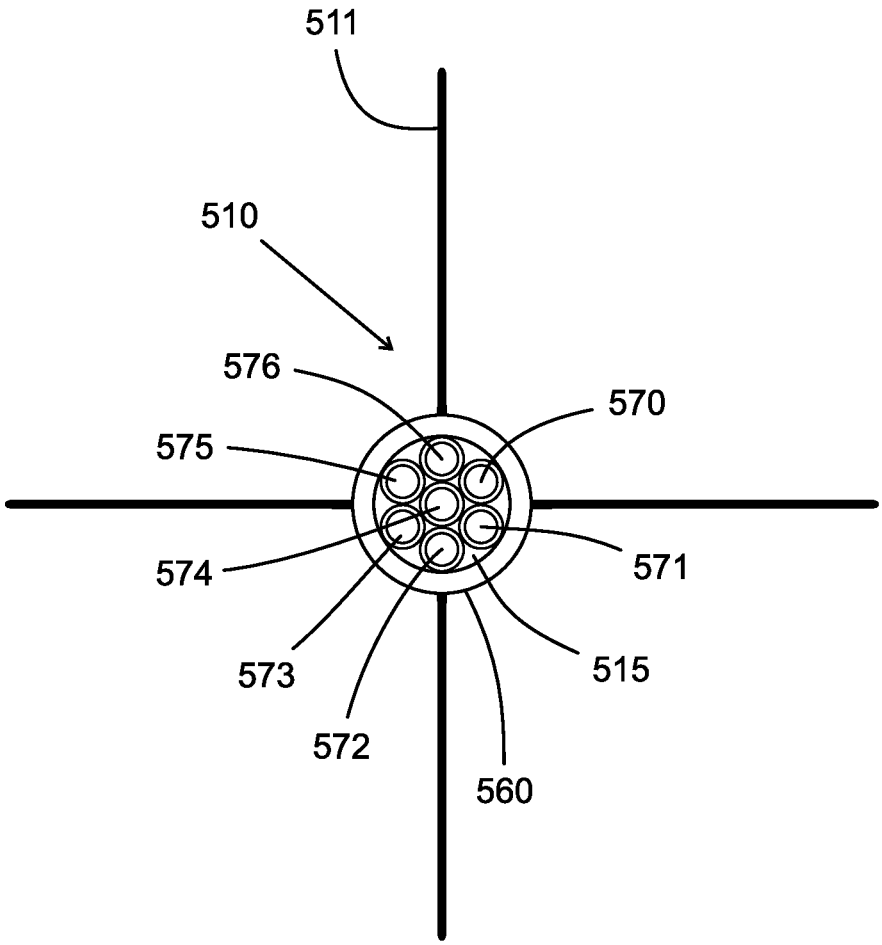
FIG. 16 is a rear view of a sixth embodiment of the apparatus of the present invention.

FIG. 16 depicts a rear view of a sixth embodiment of the apparatus of the present invention designated generally by the numeral 510. Flight unit 510 preferably comprises flight segment 511, flight unit rear portion 560, and target area 515 which preferably comprises multiple channels or receiving areas 570-576 for capturing the tip of a subsequently thrown dart. Although target area 515 comprises seven holes in FIG. 16, the target area 515 is not limited to or restricted to seven holes. This embodiment demonstrates that the rear target area need not be uniform. In game play, different values can be given depending on which of the smaller targets/channels 570-576 the subsequently thrown dart sticks to. Each of the multiple holes or receiving areas can be filled with foam, rubber, sisal, cork, or any other material that will allow a subsequently thrown dart to enter the hole and not bounce out. Alternatively, receiving areas 570-576 can be hollow, thus relying on the dart inserting far enough into the hole/tube so that it rests in position. Although the channels 570-576 are shown as equally sized and shaped, the shape and size can vary. The channels 570-576 need not be uniform in shape and size.

Figure 17:
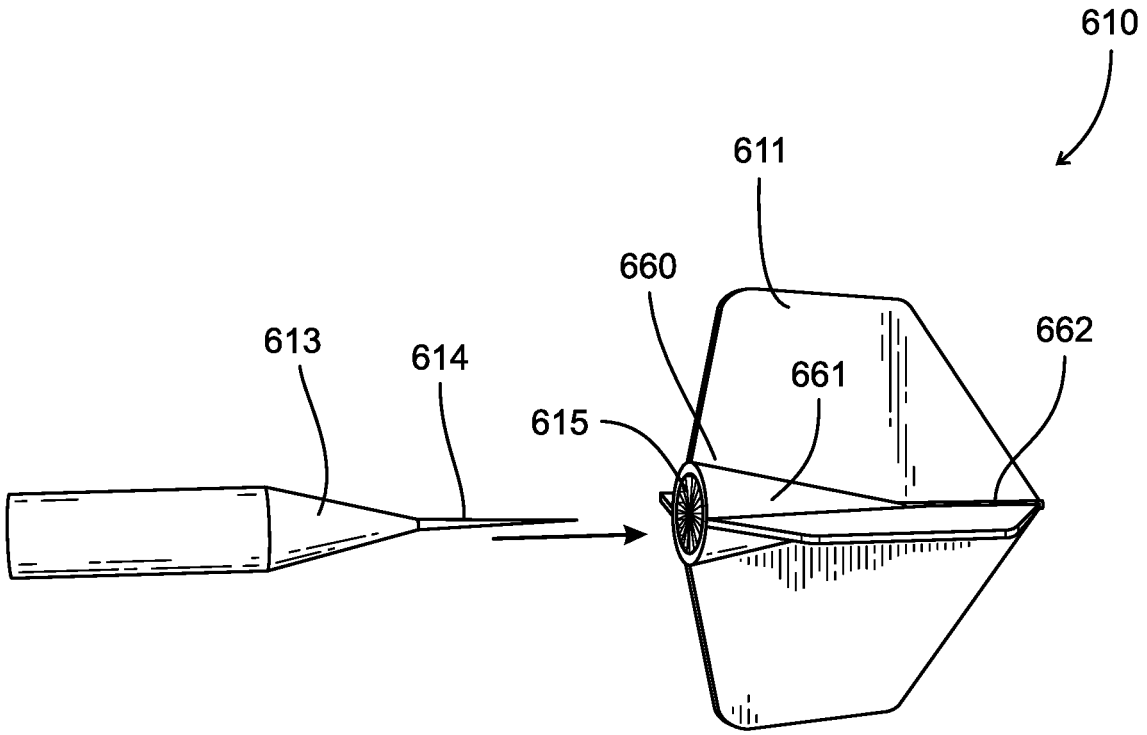
FIG. 17 is a partial, side perspective view of a seventh embodiment of the apparatus of the present invention.

FIG. 17 shows a seventh embodiment of the apparatus of the present invention designated generally by numeral 610. Flight unit 610 preferably comprises flight unit rear portion 660 which is preferably shaped so that the tapered portion 613 of a barrel/grip and point or tip 614 fit into flight unit rear portion 660 at target area 615. Flight 611 is preferably shaped so as to allow for integration of flight unit rear portion 660. Although rear portion 660 is shown as a cylindrical pyramid 661 with a narrower extension portion 662, rear portion 660 can be of any shape which matches or mimics tapered portion 613 of barrel/grip 616 and point 614.

Figure 18:
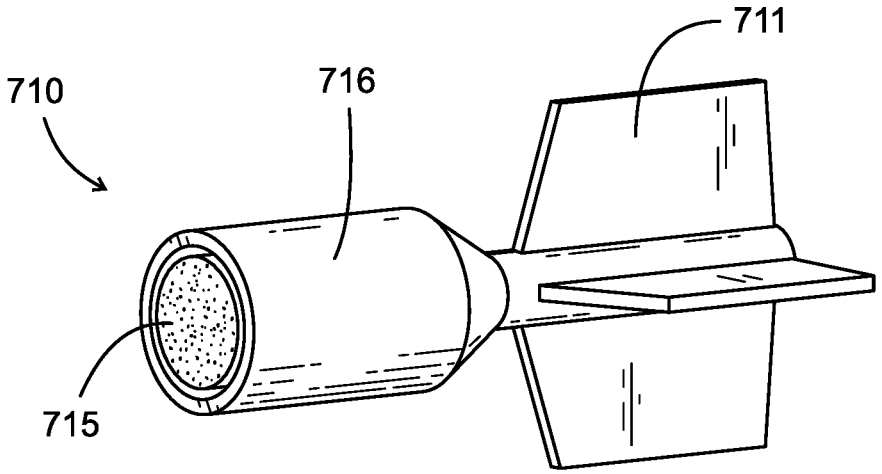
FIG. 18 is a side, perspective view of an eighth embodiment of the apparatus of the present invention.
Figure 19:
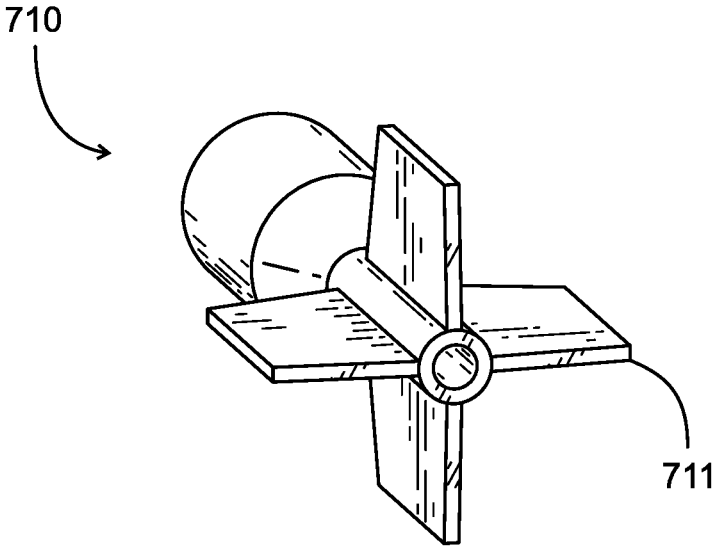
FIG. 19 is a front, perspective view of an eighth embodiment of the apparatus of the present invention.

FIGS. 18-19 show an eighth embodiment of the apparatus of the present invention designated generally by numeral 710. In this eighth embodiment, rather than have the target area nestled within the dart flight, that is, not having the dart flight extend substantially past the dart flight rearwardly, in this embodiment, the target is preferably attached to the flight (or created as a unitary piece with the flight), and in this embodiment the target portion preferably begins distally of the rearmost flight fin. Target attachment 710 preferably comprises a target area 715 and body 716 which can be attached to the rear of a dart. As shown in FIGS. 18 and 19, target attachment 710 can attach to an existing dart flight component 711. In various embodiments, this rear target 716 can be removably attached to the flight 711. In this way, the size and shape of the rear target 716 can be changed, for example, during game play.

FIGS. 20-22 show parts that make up a ninth embodiment of the apparatus of the present invention, designated generally by the numeral 810. Dart 810 comprises flight component 811, shaft or body 812, barrel/grip 813 and point/tip 814. Referring to the dart point 814 as the proximal end of the dart and the flight 811 as the distal end, the dart flight 811 comprises proximal end 822, distal end 820, and cavity or receiving component 821. Flight 811 has four fins 825 but can have fewer or more in other embodiments. Cavity 821 is sized and shaped so as to receive target insert 816 (see FIG. 21 for target insert 816). Target insert 816 preferably has a proximal end 817 and a distal end 818. At the distal end 818 of target insert body 819 is lip portion 823 has a diameter greater than proximal portion 824 of target insert 816. Target 815 preferably fills the bore of target insert 816 and can comprise any of the materials listed herein for the flight targets. When target insert 816 is inserted into cavity 821 of flight 811, lip portion 823 and target area 815 are preferably exposed rearwardly from the dart. Lip 823 is designed to prevent damage to the rear of the dart assembly and serves to deflect the tip of the second dart in or out of target area 815. Lip 823 also provides a surface for a user to grip onto to remove the cup/cork/target insert 816 from the rear of the dart assembly 810. Although flight 811 and shaft 812 are a unitary structure in this embodiment shown, they need not be. Flight target insert 816 can be replaced if, for example, during gameplay it is damaged. Additionally, the width of the lip portion 823 can vary—the greater the width of the lip portion 823 the smaller the target area 815. As seen in FIG. 22, the proximal end of shaft 812 can have an end/connector/protrusion 826 which can be attached to barrel/grips of darts of the prior art. In this way, the present invention can be sold as a unitary structure, as individual pieces which are put together to form an entire dart, or as individual parts which are added to existing dart pieces to from a dart of the present invention.

FIGS. 23-25 show the components that can make up a tenth embodiment of the apparatus of the present invention, designated generally by the numeral 910. The embodiment shown in FIGS. 23-25 is preferably similar to the embodiment shown in FIGS. 20-22 except that the size (diameter) of the cavity 911 is decreased and thus, correspondingly, the size of the target insert 916 and target area 915 have decreased. However, as the target area decreases, the area of each fin 925 increases (compare fins 825 with fins 925). The size of the fins can vary and need not be directly tied to whether or not the target area is increasing or decreasing. It is possible to have an embodiment where the target is smaller than what is shown in dart 910, and yet, the fins 925 correspondingly are smaller as well. Or the converse can happen: the fins can become even larger as the target area decreases. The dimensions and size relationships between parts that are shown in the figures are not meant to be limiting. FIG. 25 is similar to FIG. 22 in that it shows end/connector/protrusion 926 which functions in a similar manner to end/connector/protrusion 826 of the ninth embodiment.

Figure 26:
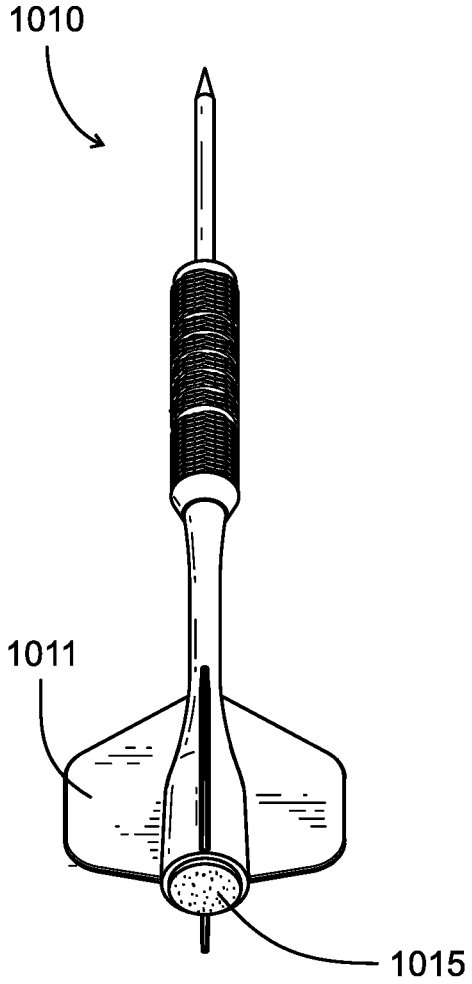
FIG. 26 is a perspective view of an eleventh embodiment of the apparatus of the present invention.
Figure 27:
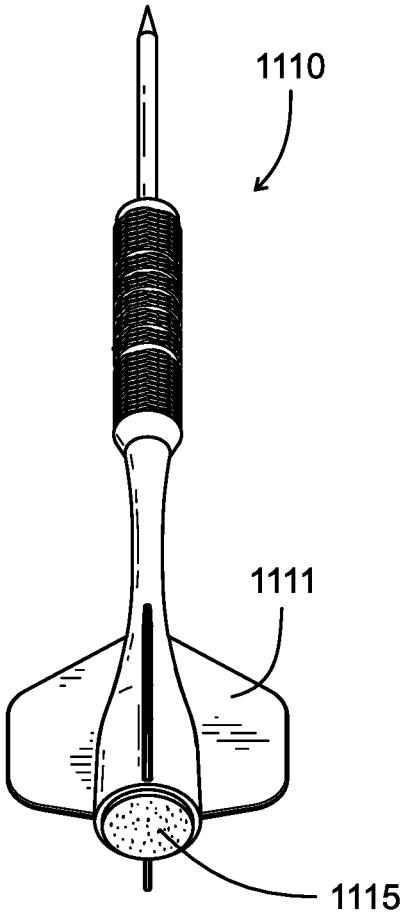
FIG. 27 is a perspective view of a twelfth embodiment of the apparatus of the present invention.

FIGS. 26 and 27 show eleventh and twelfth embodiments of the apparatus of the present invention, designated generally by the numerals 1010 and 1110, respectively. Darts 1010 and 1110 are preferably similar to the ninth and tenth embodiments. However, the target area/target portions 1015 and 1115 are not part of a larger target insert as seen in the ninth and tenth embodiments. Instead, the cavity portions are filled directly with the targets 1015, 1115. In this way, without the insert and corresponding lip, the target area is comparatively bigger than in the embodiments shown in FIGS. 20-25 (assuming cavities of the same diameter). In the eleventh and twelfth embodiments, the flight sections are shown by numerals 1011 and 1111, respectively.

The present invention also discloses a modified darts game. In the present invention, a first dart can be thrown into the dart board and a second dart can be thrown and can stick into/engage with the rear target area of the first dart. Because of the target area component of the first dart, the second dart can pierce and stick to the target area of the first dart. In standard dart designs, that would cause damage to the rear of the first dart. During gameplay, it would also result in no score in traditional dart rules.

The present invention allows for an added dimension of gameplay along with a non-fixed target location. The dart target area/capture area can be part of the flight, part of the flight unit, part of the dart shaft or an additional attachment that attaches to a dart flight or shaft. The new dart enhancement can be produced as flights for existing darts, flights with shafts attached, shafts, flight attachments, rear dart attachments, or full one-piece darts, for example. The rear of the new dart can have a circular, square, or other shape target for a dart to land in. The dart target/capture area can be made of metal, plastic, wood, vinyl, graphite or another light or suitable material, and then filled with a cork, sisal, foam, or other suitable material that can capture the tip of another dart and not have the subsequently thrown dart bounce out. Another embodiment could have the target/capture area be a mechanical device that would capture the tip of the other dart or be shaped like a spring or Chinese finger trap to capture the tip of the second dart. In various embodiments, the present invention may comprise a flat folding flight (i.e. nylon) that has a target area (which may be cone shaped, for example) in the middle to capture the tip of the other dart simply by shape. In various embodiments, there could be a version that is only single use or has an attachment target area that is single use such as a cover over the target/capture area or a piece of foam that can only be used once and then needs to be replaced. The front tip and grip area of the dart can be modified to promote the docking of the tip of the dart into the receptive area at the back of the dart. This can be done by shaping the tip and grip to fit into the rear of the dart. The dart target/capture area can be made of metal, plastic, wood, vinyl, graphite or another light material, for example, and then filled with a cork, sisal, foam, or other material, for example that can capture the tip of another dart and not have it bounce out. Another embodiment could have the target/capture area be mechanical device that would capture the tip of the other dart or shaped like a spring or Chinese finger trap to capture the tip of the second dart. Alternatively, or in addition, the various embodiments could use a material such as rubber on the grip to reduce bounce and increase friction with the docking area at the rear of the dart. The front of the grip portion or barrel can be in a pointed/cone shape to allow easier entry into the target/capture area.

The present invention can also apply to and include soft tip darts. For soft tip darts, the rear of a dart may have an area for another dart to hit which can then drive the first dart into the board for electronic scoring as opposed to having the second dart stick into the first dart as is done with traditional darts and in the embodiments depicted in the figures. Alternatively, however, the soft tip dart can be captured in a way similar to the capture of a steel tip dart.

In various embodiments, the sharp tip/spike of the dart can be stored in the target area of the rear portion of the dart. Such a feature could be advantageous for carrying and storing the darts.

The new dart and dart parts of the present invention allow several additional gameplay options, including modified scoring of traditional dart games, modified game play of traditional dart games, and entirely new game play. Some of the new options are listed below:

When a dart is thrown into the target section of a dart already in the dart board, then the scoring could be:

1. The same number of points as the dart it is stuck into.
2. Double the score of the dart it is stuck into.
3. A fixed number of points such as 20, 50, 100, etc.

If a dart is thrown into the target section of a dart already stuck into a dart that is stuck in the board then the scoring could be:

1. Triple the score of the dart in the board.
2. A fixed number of points such as 100, 150, etc.

If a player's dart is thrown into the target section of another player's dart already stuck into the dartboard:

1. The player with the dart in the board loses their points for that dart.
2. The player with the dart in the board loses their dart for the remainder of the game.
3. The player that throws their dart into the target area of the other player's dart gets additional scoring such as those listed above.

Other variants of the game can include players alternating turns or dart throws as described below:

In a particular method of gameplay of the present invention, each player throws three (3) darts and then removes them from the board. The first way to play is a take on the normal gameplay of darts where each player throws their darts and then removes them from the board at the end of their turn. The first dart thrown into the board scores the number of points on that section of the board as normal. If the second or any subsequently thrown dart sticks into the first or any previously thrown dart then the second or subsequently thrown dart can be worth the same number of points or another factor, such as double the number of points, of the first or previously thrown dart. It can also be its own point value such as 50 anytime a dart goes into the back of another dart. Similarly, if the third dart is thrown into the back of the second dart which is in the back of the first dart that could be worth the same or a different amount, such as triple the score of the first dart, or 150 points, or the same points as the first dart.

In another method of gameplay of the present invention, each player throws three (3) darts and leaves them for the next player. In this mode of play, the first player will throw their three (3) darts into the board, getting the score based on the normal dart scoring pattern. The second player will get points by throwing their dart into the board, or by throwing their dart in the back of the other player's dart. If that happens, the first player can lose their dart for the rest of the match, lose their points for that dart, or the second player could get the score of that previous dart.

In an alternative, simpler game embodiment of the present invention, the second player is the only one who can score and only by sticking a dart in the back of their opponent's dar, which could be worth a point, for example.

In another method of gameplay of the present invention, "Knockout," an attrition/killer/knockout game, wherein when the second player gets their dart in the opponent's dart, the opponent loses that dart for the rest of the game until one player has no darts left.

In another method of gameplay of the present invention, each player throws one dart, with each person alternating shots until all darts are thrown. In this mode of gameplay, players alternate their shots, and the same rules as above can apply when a dart is "robinhooded"; however the gameplay is slower.

In another method of game play, a first player throws the target dart, and then normal darts are thrown afterwards. In this gameplay, there are target darts thrown before regular darts. The target dart or darts are thrown into the board, and then the players try to throw a normal dart into the target section of the target darts. The players can do this for the score of the target dart in the dartboard scoring area or for single points for each target dart hit.

PARTS LIST

The following is a list of parts and materials suitable for use in the present invention:

Parts Number Description

10 dart
11 flight
12 shaft
13 barrel/grip
14 tip
15 target/receiving area
16 shaft rear end
17 cavity/receiving area
18 fin
110 flight unit with threaded shaft
112 shaft
116 shaft rear end
120 threaded end
210 flight unit
216 rear shaft portion
230 shaft attachment
231 body
310 flight unit
311 flight
315 target
340 folding fin
341 folding fin
342 non-folding fin
343 non-folding fin
350 arrow
360 flight unit rear portion
410 flight unit
411 flight
415 target
460 flight unit rear portion
510 flight unit
511 flight

515 target area
560 flight unit rear portion
570 channel
571 channel
572 channel
573 channel
574 channel
575 channel
576 channel
610 flight unit
611 flight
613 tapered portion
614 point
615 target area
616 barrel/grip
660 flight unit rear portion
661 cylindrical pyramid section
662 extension section
710 target attachment
711 flight
715 target area
716 body
810 dart
811 flight
812 shaft
813 barrel/grip
814 point/tip
815 target area
816 target insert
817 proximal end
818 distal end
819 target insert body
820 flight distal end
821 flight cavity
822 flight proximal end
823 lip portion
824 proximal portion
825 fin
826 connector
910 dart
911 cavity
915 target area
916 target insert
925 fin
926 connector
1010 dart
1011 flight
1015 target area
1110 dart
1111 flight
1115 target area All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A dart game to be played between at least two players, the game played with multiple throwing darts and dart board, wherein (a) at least one of the darts in play is a flight target dart, said flight target dart comprising a point, a barrel, a shaft, and a flight, wherein the flight comprises a target area, said target area being sized and shaped for receiving another dart, wherein the target area receives a tip of the other dart; and (b) game play is modified such that scoring occurs when a dart strikes and is adhered to the target area of one of the at least one flight target darts, when the flight target dart has struck and adhered to a scoring area of the dart board.

2. The dart game of claim 1 wherein a player who throws a dart into the target area of a previously thrown dart scores the numerical value of the previously thrown dart.

3. The dart game of claim 1 wherein a player who throws a dart into the target area of a previously thrown dart scores twice the numerical value of the previously thrown dart.

4. The dart game of claim 1 wherein a player who throws a dart into the target area of a previously thrown dart by another player scores the numerical value of the previously thrown dart and the player who threw the initial dart loses the same numerical value.

5. The dart game of claim 1 wherein a player who throws a dart into the target area of a previously thrown dart by another player causes the other player to lose said previously thrown dart for the rest of the game.

6. The dart game of claim 1 wherein each player has three flight target darts during game play.

7. The dart game of claim 6 wherein players alternate throws of their flight target darts during game play.

8. A dart comprising a point, a barrel, a shaft, and a flight, wherein the flight comprises a rear target area; wherein the rear target area is sized and shaped to capture a point of another dart.

9. The dart of claim 8, wherein the shaft has a proximal portion and distal portion, the proximal portion of the shaft terminating at the barrel and the distal portion of the shaft being integrated with the flight, wherein the distal portion of the shaft comprises a cavity which houses the target area.

10. The dart of claim 8, wherein the flight comprises four fins.

11. The dart of claim 8, wherein the target area is comprised of one or more of the following materials: foam, rubber, sisal, or cork.

12. The dart of claim 8, wherein the flight comprises a plurality of fins and the rear target area is located centrally of the plurality of fins.

13. The dart of claim 8, wherein the rear target area, as seen from a rear view of the dart, is circular.

14. The dart of claim 8, wherein the rear target area, as seen from a rear view of the dart, is square.

15. The dart of claim 12, wherein the fins are foldable.

16. The dart of claim 8, wherein the rear target area comprises a plurality of smaller targets.

17. The dart of claim 16, wherein the rear target area, as seen from a rear view of the dart, is circular.

18. The dart of claim 8, wherein the rear target area is housed in a removable target insert.

19. A dart comprising a point, a barrel, a shaft, and a flight, wherein the flight includes a means for receiving a point of another dart.

20. The dart of claim 19, wherein the means for receiving comprises a plug made of cork, sisal, foam, or rubber, or a combination thereof.

* * * * *